US008058493B2

(12) United States Patent
Stark et al.

(10) Patent No.: US 8,058,493 B2
(45) Date of Patent: Nov. 15, 2011

(54) REMOVING AMINES FROM HYDROCARBON STREAMS

(75) Inventors: Joseph L. Stark, Richmond, TX (US); George G. Duggan, Katy, TX (US); Walter A. Boyd, St. Louis, MO (US); Jerry J. Weers, Richmond, TX (US)

(73) Assignee: Baker Hughes Incorporated, Houston, TX (US)

( * ) Notice: Subject to any disclaimer, the term of this patent is extended or adjusted under 35 U.S.C. 154(b) by 575 days.

(21) Appl. No.: 12/188,636

(22) Filed: Aug. 8, 2008

(65) Prior Publication Data

US 2008/0319240 A1 Dec. 25, 2008

Related U.S. Application Data

(63) Continuation-in-part of application No. 10/846,051, filed on May 14, 2004, now abandoned.

(60) Provisional application No. 60/472,229, filed on May 21, 2003.

(51) Int. Cl.
*C07C 11/00* (2006.01)
*C10G 17/00* (2006.01)

(52) U.S. Cl. .... 585/16; 208/47; 208/48 AA; 208/254 H; 208/254 R; 208/289; 208/348; 252/394

(58) Field of Classification Search ..... 585/16; 422/3; 252/394; 208/254 H, 254 R, 289, 208/47, 48 AA, 348; 21/2.5 R
See application file for complete search history.

(56) References Cited

U.S. PATENT DOCUMENTS

| | | | | |
|---|---|---|---|---|
| 3,216,941 | A | 11/1965 | deVries | |
| 3,676,089 | A | 7/1972 | Morris | |
| 3,819,328 | A | 6/1974 | Go | |
| 4,105,417 | A | 8/1978 | Coon et al. | |
| 4,402,708 | A | 9/1983 | Oswald | |
| 4,448,586 | A | 5/1984 | Weidig | |
| 4,531,948 | A | 7/1985 | Knapp | |
| 4,618,411 | A * | 10/1986 | Dickakian | 208/48 AA |
| 5,114,566 | A | 5/1992 | Naeger et al. | |
| 5,254,138 | A | 10/1993 | Kurek | |
| 5,266,186 | A | 11/1993 | Kaplan | |
| 5,556,575 | A | 9/1996 | Babaian-Kibala et al. | |
| 5,885,487 | A | 3/1999 | Minevski | |
| 6,284,008 | B1 | 9/2001 | Caprotti | |
| 2004/0045875 | A1 | 3/2004 | Nguyen et al. | |

FOREIGN PATENT DOCUMENTS

| | | | |
|---|---|---|---|
| GB | 2079784 | A | 1/1982 |

OTHER PUBLICATIONS

PCT International Search Report for International Application No. PCT/US2004/015710, Oct. 6, 2004.

* cited by examiner

*Primary Examiner* — Prem C Singh

(74) *Attorney, Agent, or Firm* — Mossman Kumar & Tyler PC

(57) ABSTRACT

Corrosive amine salts in hydrocarbon streams such as desalted crude oil streams can be prevented or avoided by adding certain amine scavenging chemicals to the streams to remove the amines therefrom. Suitable amine scavengers include, but are not necessarily limited to, carboxylic anhydrides and copolymers of carboxylic anhydrides, aromatic anhydrides, isocyanates, polyisocyanates, and epoxides. The non-corrosive reaction products of the amines and/or ammonia with these scavengers are preferably oil-soluble, non-basic and thermally stable. The amine scavengers bind up and react with the amines and/or ammonia to keep them from reacting with materials such as acids (e.g. HCl) to form corrosive amine salts.

14 Claims, No Drawings

REMOVING AMINES FROM HYDROCARBON STREAMS

CROSS-REFERENCE TO RELATED APPLICATIONS

This application is a continuation-in-part application of U.S. patent application Ser. No. 10/846,051 filed May 14, 2004, now abandoned, which in turn claims the benefit of U.S. provisional application No. 60/472,229 filed May 21, 2003.

TECHNICAL FIELD

The present invention relates to methods and compositions for scavenging ammonia and/or amines, and more particularly relates, in one embodiment, to methods and compositions for scavenging amines in hydrocarbon streams, where the amine or ammonia may otherwise form a corrosive reaction product.

BACKGROUND

In the refining of petroleum products, such as crude oil, hydrochloric acid is generated which can cause high corrosion rates on the distillation unit metallurgy. Neutralizing amines are added to the overhead system to neutralize the HCl and make it less corrosive. Excess amines can form salts that will lead to corrosion. Consequently, the refining industry has, for many years, suffered from amine-hydrochloride salt deposition in crude oil towers. The problem occurs when ammonia and/or amines are present in the desalted crude. These amines react with hydrochloric acid and other acids while ascending the crude tower and deposit as corrosive salts in the tower and the top pumparound equipment. The amines can be present from several sources, including but not necessarily limited to, crude oil (e.g. $H_2S$ scavenger chemicals), slop oil (frequently containing gas scrubbing unit amines) and desalter wash water (often composed of over-head sour water containing amine neutralizer). The problem has worsened in recent years in part due to higher crude salt content, which yields higher HCl and requires more overhead neutralizer, consequently both salt reactants are present in higher quantities. Additionally, many crude towers are operated at colder top temperature, which further encourages salt formation in towers. Longer run cycles between turnarounds have caused the problem to become a priority. Clearly, amine salting in towers has become a bigger problem in recent years, and future trends indicate continuation of the problem.

Solutions examined thus far fall into two categories. First, for cases where the amine is coming in with the crude oil or slop oil, the primary option is to segregate the offending streams and keep them out of the crude unit. This approach is economically unattractive in many cases. Second, in cases where the problem occurs due to recycle of overhead neutralizer, the approach has been to switch to overhead amines that will not form a salt at tower conditions. This technique is also economically unattractive in most applications, since these alternative neutralizers cost from three to four times as much as the convention-ally used amines.

Additional changes are foreseen which are likely to make the problem even worse. The nature of "opportunity crudes" and crude quality in general are deteriorating, and further, more plants are attempting to maximize internal water reuse. A recent effort to design new amine neutralizer options for overhead systems does not offer much relief because, as noted, the amine options identified are higher cost raw materials. Even if alternative amines are identified at reasonable costs, such amines will not help in systems where tramp amines enter the system with crude oil or slop oil.

It would be desirable if methods and/or compositions could be devised that would remove, reduce, eliminate, take out or otherwise remove amines and/or ammonia from these hydrocarbon streams, as well as reduce, alleviate or eliminate corrosion caused by undesired amine salts where amines enter refinery towers.

SUMMARY

There is provided a method for least partially removing a nitrogen compound from a hydrocarbon stream to keep the nitrogen compound, such as ammonia or a volatile amine, from forming corrosive salts. Example amines include, but are not necessarily limited to, ammonia, amines of the formula R—$NH_3$, where R is a straight, branched, or cyclic alkyl or aromatic group, where R has from 1 to 10 carbon atoms, such as methylamine; alkanolamines (including, but not necessarily limited to, monoethanolamine (MEA), methyldiethanolamine (MDEA), diethanolamine (DEA)); ethylenediamine (EDA), methoxypropylamine (MOPA)—essentially any primary, secondary or tertiary amine capable of reaching a tower overhead. Although ammonia is not strictly speaking an amine, in the context herein ammonia is included in the same group of nitrogen compounds as amines.

There is additionally provided, in one form, a method of at least partially removing a hydrogen compound from a hydrocarbon stream that involves first providing a hydrocarbon stream containing at least ammonia and/or one amine. Next, the ammonia or amine is contacted with an amine scavenger in an amount effective to react with the amine and forming a product of increased molecular weight and thus preventing the newly formed product from distilling overhead. The amine scavenger is reacted with the ammonia and/or amine to form a reaction product that distills with the heavier fractions of the oil and remains in the bottoms. The amine scavenger may be a carboxylic anhydride and/or copolymer of carboxylic anhydride, an aromatic anhydride, an isocyanate and/or polyisocyanate and/or an epoxide. The amine scavenger has an absence of a reaction product of a hydrocarbyl succinic anhydride and an amine.

There is also provided, in another non-restrictive version, a treated hydrocarbon stream that has an initially present nitrogen compound at least partially removed therefrom. The hydrocarbon stream contains at least ammonia and/or one amine capable of forming a corrosive reaction product. The stream also contains an amine scavenger in an amount effective to reduce corrosion, where a suitable amine scavenger includes one or more of carboxylic anhydrides and copolymers of carboxylic anhydrides, aromatic anhydrides, isocyanates and polyisocyanates, and epoxides. Again, the amine scavenger should have an absence of a reaction product of a hydrocarbyl succinic anhydride and an amine. The treated hydrocarbon stream also includes at least one non-corrosive reaction product of the amine scavenger with ammonia and/or amine. The amount of free amines or ammonia in the hydrocarbon stream is reduced as compared to an otherwise identical stream having an absence of amine scavenger. The amines or ammonia are converted to a polymer or reacted with a polymer rendering the (previously unconverted or unreacted) amine unable to distill into lighter fractions of the hydrocarbon.

A typical boiling range for the tower overheads may be from about 400 to about 500° F. (about 204 to about 260° C.).

DETAILED DESCRIPTION

It has been discovered that additive chemicals react with or "scavenge" or otherwise remove tramp or residual amines and/or ammonia from desalted crude oil streams or other hydrocarbon streams where ammonia or amines may be present from any source, and that may over time and/or under certain conditions contact reactants and form undesirable corrosive products. Organic amines and/or ammonia are frequently present in the desalted crude oil as contaminants from upstream treatment, via desalter wash water or from introduction of slop oils. These basic compounds can, under certain conditions, react with HCl and other acids to form corrosive salts. The conditions in crude distillation towers often favor these reactions. The fouling and corrosion that results from the formation of the salts increases the refinery operating and maintenance costs significantly. Efforts to minimize or exclude the tramp bases, amines or ammonia from the unit feed streams are often ineffective or economically infeasible. Consequently, there is a need for another means of removing these bases from the desalted crude. The inventive amine scavenger method is one such approach. It will be appreciated that in the context herein, the term "amine scavenger" encompasses additives that scavenge ammonia as well as amines. In most embodiments, it is expected that the scavenger be added anywhere between the desalter outlet and the bottom of the distillation tower; in a particular non-limiting embodiment, the amine scavenger is added at or near the bottom of the distillation tower.

Volatile amines in this method include any amine capable of reaching a tower overhead and capable of forming a deposit under unit conditions, i.e. during a hydrocarbon processing operation. In another non-limiting embodiment, volatile amines include, but are not necessarily limited to, ammonia, amines of the formula R—$NH_3$, where R is a straight, branched, or cyclic alkyl or aromatic group, where R has from 1 to 10 carbon atoms and where R may be substituted with oxygen. Diamines of the formula $H_2NR'NH_2$ where R' is a straight or branched alkylene group of from 2 to 10 carbon atoms also fall within the definition of volatile amines herein, and again, R' may also be substituted with oxygen. Amines and diamines containing oxygen also fall within the definition of volatile amines. More specific examples of volatile amines include, but are not necessarily limited to, methylamine; alkanolamines that may include, but are not necessarily limited to, monoethanolamine (MEA), methyldiethanolamine (MDEA), diethanolamine (DEA); diamines such as ethylenediamine (EDA); other amines containing oxygen, including, but not necessarily limited to methoxypropylamine (MOPA) and the like and mixtures thereof.

Additive chemistry has been found to prevent amines and/or ammonia from causing problems in a distillation tower, effectively at least partially converting then into higher molecular weight compounds by reacting with polymers forming covalent bonds keeping the amines from distilling overhead. At least two possibilities exist to prevent amines or ammonia from causing problems in a tower. First, the additive chemicals may produce a reaction product with the amine or ammonia that is neutral, such that it will not react with HCl or other acids, and the reaction product is thermally stable so that it will not decompose and release the amine/ammonia in the distillation tower. Second, the additive chemicals could produce a reaction product with amines or ammonia that generates a high boiling point product that remains oil soluble in the tower bottoms where it does not cause further problems. The methods and treated compositions herein are not limited to either of these two possibilities.

In another non-limiting embodiment, the reaction product is oil soluble, non-corrosive, non-basic and thermally stable. "Non-basic" in the context herein means that the product will not accept or receive a proton from another sub-stance. By "thermally stable" is meant that the reaction product is stable to conditions of a crude unit furnace. Crude unit furnace conditions having the oil containing the reaction product are capable of reaching 700° F. (371° C.) for 5 to 15 minutes and thus the reaction product should not decompose at this temperature or lower temperatures.

It has been discovered that there are a number of chemical functionalities that are effective in reacting with amines or ammonia to produce compounds that will no longer form salts in the crude tower overhead or at least reduce or inhibit the formation of salts. It should be understood that the process is not technically "removing" the nitrogen. The amine or ammonia is converted into a product that will prevent it from distilling overhead or converted into a product that will not react with HCl (or other acid) to form salts. The reaction between the polymer and the amine will form a thermally stable product that does not distill into the tower tops or overheads, but remains with the heavier fraction of the oil. Thus, the amines and/or ammonia are converted into a product that goes with or travels with the hydrocarbon bottoms. In doing this the formation of any amine salts that could lead to corrosion in the tower tops is prevented. Because there is no amine, or at least less amine, to react with any acidic species to form salts that would lead to under deposit corrosion in the upper portion of the distillation tower, corrosion is reduced or eliminated. The reaction between the amine and isocyanate, e.g., will form a thermally stable material that will no longer react with HCl or other acid.

"Under deposit corrosion" is when the amine reacts with HCl or other acids to form a salt. The salt is typically water soluble and can concentrate in various areas of the tower. When the material begins to precipitate from the liquid phase it creates a deposit that acts as a barrier for acidic material to concentrate on the underside of the deposit and cause aggressive corrosion. Since there is a deposit on top of the corrosive solution it will not readily be washed away with the flow of hydrocarbon in the tower. This will result in localized high levels of corrosion.

In one non-limiting example, the scavenger is a carboxylic anhydride or copolymer of carboxylic anhydride. Within the context herein, the term "polymer" or "copolymer" includes oligomers and co-oligomers. These copolymers may be made by conventional techniques known to those of ordinary skill in the art. Suitable carboxylic anhydrides include aliphatic, cyclic and aromatic anhydrides, and may include, but are not necessarily limited to maleic anhydride, succinic anhydride, glutaric anhydride, tetrapropylene succinic anhydride, phthalic anhydride, trimellitic anhydride (oil soluble, non-basic), and mixtures thereof. Typical copolymers include reaction products between these anhydrides and alpha-olefins to produce oil-soluble products. Suitable alpha olefins include, but are not necessarily limited to ethylene, propylene, butylenes (such as n-butylene and isobutylene), C2-C70 alpha olefins, polyisobutylene, and mixtures thereof. Suitable amine scavengers also include, but are not necessarily limited to, polymers and copolymers of carboxylic anhydrides, aromatic anhydrides, and mixtures of these anhydrides, where the number of anhydride units is greater than three, for instance having more than three anhydride units, including quad-, penta-, hexa- and higher imide structures.

A typical copolymer is a reaction product between maleic anhydride and an alpha-olefin to produce an oil soluble scavenger. Reacting 4 moles of propylene with one mole of succinic anhydride gives tetrapropylene succinic anhydride, and one copolymer acceptable as a suitable scavenger for the inventive method. Another useful copolymer reaction product is formed by a 1:1 stoichiometric addition of maleic anhydride and polyisobutylene. The resulting product has a weight average molecular weight range higher than about 2,000 up independently to about 10,000, alternatively from greater than about 2,500 independently up to about 10,000, and in another non-limiting embodiment from about 2,700 up to about 10,000. Activity was also seen with dodecylsuccinic anhydride, a compound with just one anhydride functionality, and with anhydride copolymers with molecular weights ranging from about 30,000 to about 50,000. In one non-limiting embodiment, the anhydrides when reacted with amine or ammonia should produce a product that is soluble in the oil phase. The carboxylic anhydrides and copolymers of carboxylic anhydrides with olefins will react with amines or ammonia to form stable amides or subsequent imide compounds. More specific examples include, but are not necessarily limited to, copolymers made by the reaction of maleic anhydride with C6 to C50 alpha-olefins, for instance, 1 octene, 1-dodecene, 1-hexadecene. In more specific non-limiting embodiments, the alpha olefins may range from C20-24, alternatively C26-32. A copolymer made by reacting maleic anhydride with polyisobutylene is also one copolymer of interest.

Isocyanates and/or polyisocyanates may also be used to scavenge amines or ammonia and prevent them from forming salts in refinery towers. Isocyanates or polyisocyanates will react with amines to form ureas. These ureas will no longer react with HCl or other acids to form the corrosive salts. Suitable isocyanates and polyisocyanates include, but are not necessarily limited to, isophorone diisocyanate, polymeric materials with a molecular weight range of from about 100 to about 5000, isophorone diisocyanate homopolymer, tolyl isocyanate, phenylene diisocyanate, cyclohexylene diisocyanate, and mixtures thereof.

Epoxides can also be used to scavenge problematic amines herein. The epoxides used should produce reaction products that are oil soluble in one non-restrictive version. If the amine or ammonia reaction products formed have secondary or tertiary amine functionalities associated with the compounds then the resulting product must be oil soluble and should not distill into the tower overhead, in one non-limiting embodiment. Epoxides suitable as amine or ammonia scavengers for the method herein include, but are not necessarily limited to, alpha-olefin epoxides having carbon chains of C6 or higher (such as epoxydecane, epoxydodecane, epoxyethylbenzene), methyl oleate oxide, glycidyl hexadecyl ether, glycidyl 4-methoxyphenyl ether, and mixtures thereof.

In one non-limiting embodiment, the amine scavenger has a weight average molecular weight greater than 2,000. Alternatively, the amine scavenger may have a molecular weight greater than about 2,500 independently up to about 50,000. In another non-limiting embodiment, the molecular weight may be about 2,700 or greater. In another non-restrictive version, the amine scavenger has an absence of a reaction product of a hydrocarbyl succinic anhydride and an amine, in particular the film-forming reaction products of U.S. Pat. No. 5,556,575, incorporated herein by reference, particularly the mono, di or tri-imide reaction product of a hydrocarbyl succinic anhydride and an amine having at least one primary amine group. Further, the amine scavengers herein have an absence of succinimides.

Typical application of the additives may involve the addition of between about 1 and about 100 ppm of additive injected into the desalted crude, in one non-restrictive version, but in another non-restrictive embodiment the amount of amine scavenger is greater than 100 ppm, alternatively greater than about 10,000 ppm. In another non-limiting embodiment, the addition proportion ranges between about 10 and about 30 ppm. Alternatively, the addition of amine scavenger may be at a rate of up to about 10 times the amount of amine(s) or ammonia present in the petroleum fluid or hydrocarbon stream; in another non-limiting embodiment, at a rate of up to about 5 times the amount of amine(s) or ammonia present. Testing indicates that there is typically sufficient time and temperature for the desired reaction to occur. In any event, sufficient time and/or conditions should be permitted so that the amine scavenger reacts with substantially all of the amine or ammonia present. By "substantially all" is meant that no significant corrosion problems occur due to corrosive amine salts and/or that no substantial amounts of amine or ammonia amounts are present in the upper sections (overheads) of the distillation tower. The resulting reaction products of amine or ammonia with the scavenger are thermally stable at crude distillation conditions.

It will be understood that the complete elimination of corrosive salt formation or complete removal of the amines and/or ammonia is not required for successful practice of the method. All that is necessary for the method to be considered successful is for the treated hydrocarbon stream distilling into the upper sections (overheads) of the tower to have reduced amounts of amines and/or ammonia as compared to an otherwise identical hydrocarbon stream having no amine scavenger, and/or a reduced corrosion capability as compared to an otherwise identical hydrocarbon stream having an absence of amine scavenger.

The invention will now be described with respect to particular Examples that are not intended to limit the invention but simply to illustrate it further in various non-limiting embodiments.

EXAMPLES 1-8

A stainless steel bomb of 50 ml capacity was used throughout the series of experiments. Twenty (20) ml of heavy white mineral oil spiked with 10 ppm of methanolamine (MEA) and 10 ppm ethylamine (EA, in 20 μL water) were used as the test sample in all cases. A 4% solution of scavenger (2000 ppm) in toluene solution (100 μL) was added to the bomb for each experiment.

A gas chromatograph oven was used for heating of the test vessels. Prior experiments had calibrated the GC oven heating parameters and shown that the internal temperature of the sample in the bomb lagged the oven setpoint of 500° F. (260° C.) by 100° (56° C.) after 10 minutes of heating. To raise the sample to 500° F. (260° C.) in a reasonable time and compensate for the temperature lag, a setting of 600° F. (316° C.) was used for the oven set point. Rapid cooling of the oven (90° C./min.) after the heating cycle produced a sample temperature of 240° F. (127° C.) in 10 minutes. Thus, the oven set point was 600° F. (316° C.) for a heating time of 8 minutes and then a cooling time of 10 minutes. The time and temperature parameters were set to simulate the typical time and temperature conditions of a typical crude unit preheat system.

Immediately after each 18-minute experiment, 10 ml of Dl water were added and the bomb resealed. This technique rapidly quenched the sample temperature further to about 110° F. (43° C.) and still allowed the benefit of a warm oil with lowered viscosity for the subsequent extraction. The bomb was shaken for 5 minutes to extract the amines. The water was then separated by centrifugation and analyzed directly by Ion Chromatography. Some of the additives increased the stability of emulsions formed during the extraction. The results are given in Table I. As noted above, all Examples were conducted at 500° F. (260° C.) except for calibration Example 1, which was performed at 70° F. (21° C.).

TABLE I

Amine Scavenging by Various Chemicals

| Ex. | Scavenger | MEA | EA |
|---|---|---|---|
| 1 | None (calibration) | Present | Present |
| 2 | None (calibration) | Present | Present |
| 3 | Dodecylsuccinic anhydride | Some loss | Some loss |
| 4 | Maleic anhydride alpha olefin copolymer C26-C32 | Absent | Absent |
| 5 | Isocyanate polymer | Absent | Present |
| 6 | Maleic anhydride alpha olefin copolymer C20-C24 | Absent | Absent |
| 7 | Succinic anhydride/partially esterified with alcohol - alpha olefin copolymer | Absent | Absent |

It is noted that some amine scavenging was observed for all Examples (the exception being EA in Example 5) and that essentially complete amine scavenging occurred for nearly all of the Examples. It will be appreciated that there are substantial benefits to the subject method, including reducing or eliminating corrosive amine salts in hydrocarbon streams, particularly in crude oil refining and processing. This benefit can be obtained using readily available amine scavengers.

In the foregoing specification, the invention has been described with reference to specific embodiments thereof. The amine scavengers of this method would be expected to be useful in other hydrocarbon processing operations besides those explicitly mentioned. It will be evident that various modifications and changes can be made to the methods and fluids of the invention without departing from the broader spirit or scope of the invention as set forth in the appended claims. Accordingly, the specification is to be regarded in an illustrative rather than a restrictive sense. For example, specific amine scavengers and proportions thereof falling within the claimed parameters, but not specifically identified or tried in particular compositions, are anticipated and expected to be within the scope of this invention.

What is claimed is:

1. A method of at least partially removing a nitrogen compound from a hydrocarbon stream comprising:

introducing a hydrocarbon stream to a distillation tower, where the hydrocarbon stream contains at least one nitrogen compound selected from the group consisting of ammonia and volatile amines;

contacting the nitrogen compound with an amine scavenger in an amount effective to at least partially remove the nitrogen compound from the hydrocarbon stream, where the amine scavenger is selected from the group consisting of:

carboxylic anhydrides and copolymers of carboxylic anhydrides, aromatic anhydrides, and mixtures of these anhydrides;

where the amine scavenger has an absence of a reaction product of a hydrocarbyl succinic anhydride and an amine; and contacting the nitrogen compound with the amine scavenger under reaction conditions sufficient to form an oil-soluble, non-corrosive, non-basic, thermally stable reaction product that remains in tower bottoms during distillation.

2. The method of claim 1 where the at least one nitrogen compound is ammonia.

3. The method of claim 1 where the amine scavenger has a molecular weight greater than 2,500.

4. The method of claim 1 where the amine scavenger is selected from the group consisting of polymers and copolymers of carboxylic anhydrides, aromatic anhydrides, and mixtures of these anhydrides, where the number of anhydride units is greater than three.

5. The method of claim 1 where the effective amount of amine scavenger is greater than 100 ppm based on the hydrocarbon stream.

6. The method of claim 1 where the amine scavenger is a copolymer selected from the group consisting of a reaction product of maleic anhydride and polyisobutylene, a reaction product of maleic anhydride and at least one C20-24 alpha olefin, and a reaction product of maleic anhydride and at least one C26-32 alpha olefin.

7. A method of removing a nitrogen compound from a desalted crude oil stream, where the desalted crude oil stream contains at least one nitrogen compound selected from the group consisting of ammonia and volatile amine capable of forming a corrosive reaction product, the method comprising:

contacting the nitrogen compound with an amine scavenger in an amount effective to at least partially remove the amine from the desalted crude oil stream, where the amine scavenger is selected from the group consisting of:

carboxylic anhydrides and copolymers of carboxylic anhydrides, aromatic anhydrides, and mixtures of these anhydrides;

where the effective amount of amine scavenger is at least approximately stoichiometrically functionally equivalent to the nitrogen compound present in the desalted crude oil stream, and where the amine scavenger has an absence of a reaction product of a hydrocarbyl succinic anhydride and an amine;

contacting the nitrogen compound with the amine scavenger under reaction conditions sufficient to form an oil-soluble, non-corrosive, non-basic, thermally stable reaction product; and distilling the desalted crude oil stream where the oil-soluble, non-corrosive, non-basic, thermally stable reaction product remains in tower bottoms.

8. The method of claim 7 where the at least one nitrogen compound is ammonia.

9. The method of claim 7 where the amine scavenger has a molecular weight greater than 2,500.

10. The method of claim 7 where the amine scavenger is selected from the group consisting of polymers and copolymers of carboxylic anhydrides, aromatic anhydrides, and mixtures of these anhydrides, where the number of anhydride units is greater than three.

11. The method of claim 7 where the effective amount of amine scavenger is greater than 100 ppm based on the hydrocarbon stream.

12. The method of claim 7 where the amine scavenger is a copolymer selected from the group consisting of a reaction product of maleic anhydride and polyisobutylene, a reaction product of maleic anhydride and at least one C20-24 alpha olefin, and a reaction product of maleic anhydride and at least one C26-32 alpha olefin.

13. The method of claim 1 where the amine scavenger is further selected from the group consisting of isocyanates, polyisocyanates and epoxides.

14. The method of claim 7 where the amine scavenger is further selected from the group consisting of isocyanates, polyisocyanates and epoxides.

* * * * *